US005725165A

United States Patent [19]

Haasen et al.

[11] Patent Number: 5,725,165

[45] Date of Patent: Mar. 10, 1998

[54] METHOD OF MONITORING THE MOVING YARN AT A WINDING STATION OF AN AUTOMATIC WINDING FRAME

[75] Inventors: Rolf Haasen, Mönchengladbach; Heribert Kargel, Viersen; Horst Kippe, Mönchengladbach, all of Germany

[73] Assignee: W. Schlafhorst AG & Co., Moenchengladbach, Germany

[21] Appl. No.: 764,691

[22] Filed: Dec. 11, 1996

Related U.S. Application Data

[63] Continuation-in-part of Ser. No. 275,998, Jul. 15, 1994, abandoned.

[30] Foreign Application Priority Data

Jul. 17, 1993 [DE] Germany ..... 43 23 994.3

[51] Int. Cl.[6] ..... B65H 63/00; B65H 63/02

[52] U.S. Cl. ..... 242/36; 242/37 R; 364/470

[58] Field of Search ..... 242/36, 35.6 E, 242/37 R; 364/470

[56] References Cited

U.S. PATENT DOCUMENTS

| | | | |
|---|---|---|---|
| 3,371,069 | 2/1968 | Goto et al. | 364/470 |
| 3,522,913 | 8/1970 | Werffeli | 242/36 |
| 3,688,958 | 9/1972 | Rydborn | 242/37 R X |
| 3,734,422 | 5/1973 | Loepfe | 242/36 |
| 3,863,241 | 1/1975 | Kamiyamaguchi et al. | 242/37 R X |
| 3,892,951 | 7/1975 | Stutz | 364/470 |
| 4,292,868 | 10/1981 | Werffeli | 242/36 X |
| 4,319,720 | 3/1982 | Ueda | 242/36 X |
| 4,455,549 | 6/1984 | Rydborn | 242/37 X |
| 4,758,968 | 7/1988 | Lord | 364/470 X |
| 4,804,151 | 2/1989 | Kathke | 242/37 R X |
| 4,924,406 | 5/1990 | Bergamini et al. | 242/36 X |
| 5,082,194 | 1/1992 | Grecksch et al. | 242/36 X |

FOREIGN PATENT DOCUMENTS

| | | |
|---|---|---|
| 0 401 600 A2 | 12/1980 | European Pat. Off. . |
| 0 419 827 A2 | 4/1991 | European Pat. Off. . |
| 1 760 969 | 10/1973 | Germany . |
| 2821792 A1 | 11/1978 | Germany . |
| 3623898 A1 | 1/1987 | Germany . |
| 3937824 A1 | 5/1991 | Germany . |
| 389 470 | 7/1965 | Switzerland . |
| 526 459 | 9/1972 | Switzerland . |

*Primary Examiner*—Michael Mansen

*Attorney, Agent, or Firm*—Kennedy Covington Lobdell & Hickman, LLP

[57] ABSTRACT

A method for monitoring a traveling yarn at a winding station of an automatic winding machine having an electronic slub catcher which produces an AC voltage signal proportional to a dynamic yarn signal responsive to yarn movement and a yarn cutting signal responsive to a fluctuation in yarn dimension outside a predetermined tolerance range includes the steps of producing a static yarn signal responsive to the presence of yarn in the electronic slub catcher, monitoring and evaluating the static yarn signal, producing a separating signal responsive to the absence of static yarn signal due to the absence of yarn from the slub catcher and monitoring and evaluating the separating signal.

6 Claims, 4 Drawing Sheets

METHOD OF MONITORING THE MOVING YARN AT A WINDING STATION OF AN AUTOMATIC WINDING FRAME

CROSS-REFERENCE TO RELATED APPLICATION

The present application is a continuation-in-part of Hassen et al U.S. patent application Ser. No. 08/275,998, entitled METHOD OF MONITORING THE MOVING YARN AT A WINDING STATION OF AN AUTOMATIC WINDING FRAME Jul. 15, 1994 now abandoned.

BACKGROUND OF THE INVENTION

The present invention relates to a method of monitoring a traveling yarn at a winding station of an automatic winding machine by means of an electronic slub catcher, which produces a dynamic yarn signal as a result of yarn movement, and a yarn catcher cutting signal indicative of the fluctuations in the yarn mass or yarn volume. Both signals may be derived from the AC voltage signal being generated by the slub catcher. A separating signal in the form of a pulse for actuating a yarn separating system is generated using the catcher cutting signal in case of yarn irregularities which are outside of a predetermined tolerance range.

The traveling yarn is constantly monitored at the winding stations of automatic winding machines by means of electronic yarn monitors, usually also called electronic slub catchers, which produce electrical signals proportional to predetermined yarn characteristics. This is known generally from Swiss Patent 389 470. The electrical signal, which is generated by the yarn in a measuring slit formed in a measuring head of the electronic slub catcher is evaluated after it has been amplified. The generated AC voltage, which is rectified to a DC voltage for evaluation, represents fluctuations in the diameter of the yarn. By means of an appropriate setting of tolerance limits for this AC voltage it can be determined which fluctuations in the diameter and, consequently, the mass of the yarn are to be permitted and which fluctuations are out of tolerance. Once the slub catcher has detected such a yarn irregularity, a separating pulse for a separating device is generated. As a result, it is possible to remove the yarn fault. A subsequent yarn connecting process provides the conditions for the continuation of the winding process.

Besides the evaluation of the AC voltage generated during the yarn movement regarding fluctuations in diameter or mass of the yarn, a dynamic signal is produced by which the yarn movement is monitored.

In order to additionally determine whether the yarn has left the measuring slit after the dynamic yarn signal is no longer received, particularly if the bobbin has run out, it was proposed in Swiss Patent 467 209 to evaluate a negative voltage peak generated when the yarn leaves the measuring slit, which may indicate that a bobbin change is necessary.

More recently, the presence of yarn is checked within the framework of a connecting cycle as described in German patent publication DE 39 37 824 A1. As taught therein, it is no longer required to detect the movement of the yarn end through the slub catcher prior to the start of the yarn connecting cycle to determine bobbin change requirements. However, since the yarn which was placed into the measuring slit of the catcher at the time of its feeding would not then be moving, no dynamic yarn signal would then be generated. For this reason, such an electronic slub catcher has a further evaluation channel for a static yarn signal to detect the presence of the yarn in the measuring slit.

SUMMARY OF THE INVENTION

It is therefore an object of the present invention to provide an improved method for monitoring moving yarn. More particularly, it is an object of the present invention to provide a method for monitoring a traveling yarn at a winding station of an automatic winding machine having an electronic slub catcher. A specific object is to provide such a yarn monitoring method which produces an AC voltage proportional to a dynamic yarn signal responsive to yarn movement and a yarn cutting signal responsive to a fluctuation in yarn dimension which is outside a predetermined tolerance range. The method includes the steps of producing in the electronic slub catcher a static yarn signal responsive to the presence of yarn in the electronic slub catcher, monitoring and evaluating the static yarn signal, producing in the electronic slub catcher a separating signal responsive to the absence of the static yarn signal due to the absence of yarn from the electronic slub catcher, and monitoring and evaluating the separating signal.

By monitoring the static signal, i.e., the presence of the yarn in the measuring slit of the electronic slub catcher even during the winding process, it is possible to detect even a temporary removal of the yarn from the measuring slit and to react accordingly. However, the short absence of the signal caused by the yarn movement would not have any effect. In order to maintain the productivity of the machine, a short absence or weakening of the yarn movement signal is not considered sufficiently important to disrupt winding operations. It should be taken into consideration that a short smooth yarn section without significant mass or volume fluctuations and without projecting fibers is a frequent occurrence and is not indicative of a yarn fault which must be removed. For this reason, further steps, e.g., stopping the winding process and initiating a yarn connecting operation, are only commenced when the yarn movement signal is absent for a significant yarn travel distance, e.g., 0.5 to 1.0 m.

Sometimes yarn defects which have reached the yarn package, e.g., snarls or loops, were not detected because they did not pass through the measuring slit of the slub catcher. Then, if the yarn was not out of tolerance after the yarn moved back into the measuring slit, no separating pulse was triggered because the dynamic yarn signal was absent only for a short time. The present invention provides that a separating pulse is generated even in case of such a yarn defect so that the subsequent elimination of the yarn defect becomes possible.

Further, electromagnetic disturbances in the area of the slub catcher may cause the dynamic yarn signal to be maintained even if the yarn has left the measuring slit. There, the winding operation would not be interrupted. Rather, the take-up bobbin would be driven during the entire time the dynamic yarn signal is maintained, without yarn being wound. As a result, the surface of the yarn package would possibly suffer considerable damage, depending on the length of this process. The yarn end would be pressed into the yarn package so deeply that, likely, it could no longer be found by automatic means.

According to the present invention, the absence of the yarn would be detected by the absence of the static yarn signal and a separation signal would be triggered. In connection with this it is assumed that, basically, a separation signal results in the stoppage of the winding station.

In case the static yarn signal is absent for the above discussed reasons and does not reappear, the yarn likely is broken. For this reason, it might be sufficient to stop the winding station without a separation process. However, since, for example, the yarn could run outside the measuring slit or may need to be shortened, it is advantageous to trigger a separation signal which is useful when the yarn lies or runs in the area of the separating device.

The present invention make it possible to detect and remedy virtually all defects which up to now had not been discovered and additionally to effectively monitor other malfunctions of the slub catcher itself.

In accordance with the present invention, the method for monitoring a traveling yarn preferably further includes the steps of producing the static yarn signal from the AC voltage produced by the electronic slub catcher and digitizing the yarn signal for enhanced monitoring and evaluation.

Even though the present invention contemplates providing a yarn presence sensor, e.g., a photoelectric barrier, for forming the static yarn signal, it is preferred to derive the static yarn signal from the AC voltage signal generated by the catcher from the moving yarn and to digitize it.

Further, the present invention may preferably include the steps of retaining in a memory location a separating signal generated prior to the expiration of a predetermined time period following the absence of the static yarn signal; determining whether a separating signal emitted from the slub catcher resulting from a signal generated when the yarn reenters a measuring slit of the slub catcher and when the yarn dimension is outside the predetermined tolerance; and transmitting the stored separating signal to a yarn manipulating device as a result of a positive determination that a separating signal has been emitted from the slub catcher resulting from a signal generated when the yarn reenters a measuring slit of the slub catcher and when the yarn dimension is outside the predetermined tolerance range.

It should be noted that the separation of the yarn on the basis of its temporary absence from the measuring slit is preferably of secondary importance to a determination of whether other factors are causing any spinning station stoppage.

It is further preferred that the present invention include the steps of retaining in a memory location a separating signal generated as a result of the absence of the static yarn signal; determining whether the dynamic yarn signal is absent during a predetermined time period; and transmitting the separating signal to a yarn manipulating device responsive to a determination that the dynamic yarn signal has been absent for the predetermined time period.

It is therefore possible to select the optimal stop method. For example, when the bobbin has become devoid of yarn, it can happen that, prior to the passage of the yarn end through the measuring slit, the yarn, which has suddenly lost its tension, briefly leaves the monitoring slit and then returns back into it. With immediate separation based on the brief loss of the static yarn signal, the yarn end could be cut off and remain uncontrolled in the spinning station or run up on the yarn package since this piece of yarn is disposed after the cutting location, it would not be aspirated by a yarn capture nozzle customarily disposed in the area of the separating device. Therefore, this loose piece of yarn could lead to later problems.

Preferably, the method for monitoring a traveling yarn further includes the steps of determining whether a generated separation signal results from a loss of the static yarn signal; increasing the length of a yarn portion unwound during the unwinding of detected yarn on an output side of the slub catcher responsive to a positive determination that the generated separation signal has resulted from the loss of the static yarn signal, the amount of increased length being sufficient to cause a yarn portion causing the absence of the static yarn signal to be aspirated by a suction nozzle during a yarn connecting operation.

Additionally, the separating device should not be operated when there is no yarn in its area. In accordance with the present invention, and as a result of the delayed separation resulting from the brief absence of the static yarn signal, the separating device can perform the correct separating action on the moving yarn. In that regard, it must be taken into account that the separating procedures are performed differently, for example, in case of a detected slub on the yarn requiring a catcher cut, and in case of a yarn break between the catcher and the take-up bobbin (i.e., with a moving or stationary yarn). With a catcher cut, a separating blade is operated first and a clamping device disposed upstream thereof is actuated directly thereafter. In case of a yarn break downstream of the slub catcher, clamping is performed first and then the yarn end, which normally had previously been aspirated by a downstream yarn capture nozzle is separated and is then removed by the yarn capture nozzle.

The described delayed separation of the yarn, based on a brief loss of the static yarn signal, also results in a situation wherein the separated yarn portion running up on the yarn package and located behind the separation point is no longer than the separated yarn portion resulting from other cases of early interruption of the winding process. Accordingly, it is necessary to ensure that the yarn portion which has been aspirated by the suction nozzle during a yarn connecting cycle is correspondingly longer, so that the defective portion is also aspirated and is not reinserted during the yarn connecting process.

DESCRIPTION OF THE PREFERRED EMBODIMENT

Figure 1:
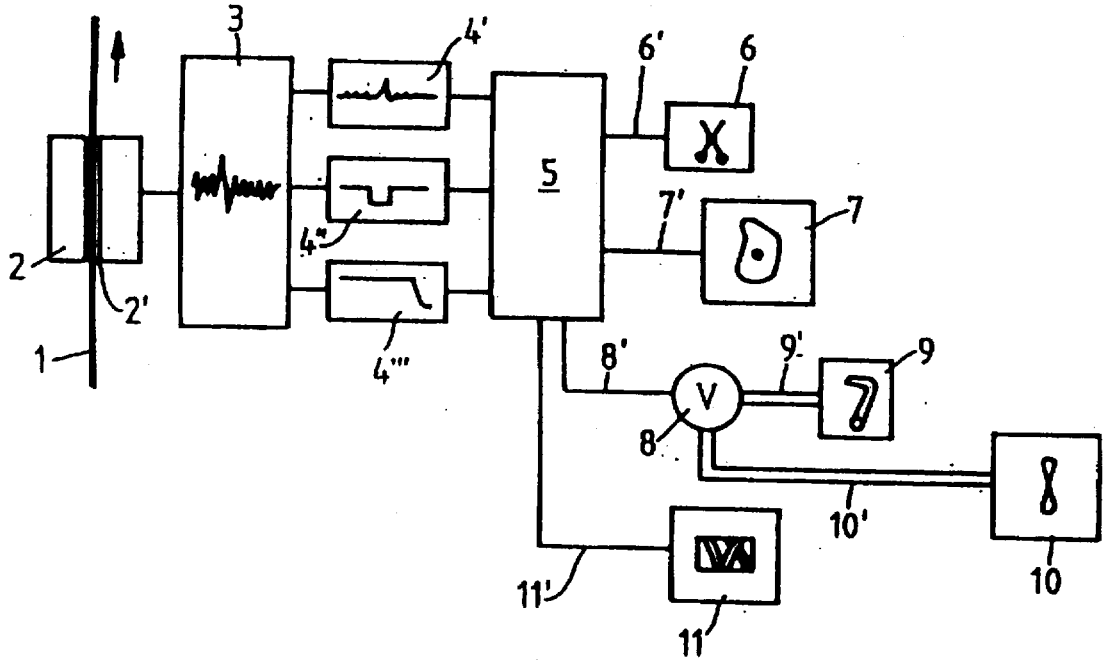
FIG. 1 is a schematic illustration of the components required to perform the steps of the preferred embodiment of the method of the present invention.

Turning now to the drawings, and more particularly to FIG. 1, the components suitable for executing the method in accordance with the present invention are illustrated.

Figure 6:
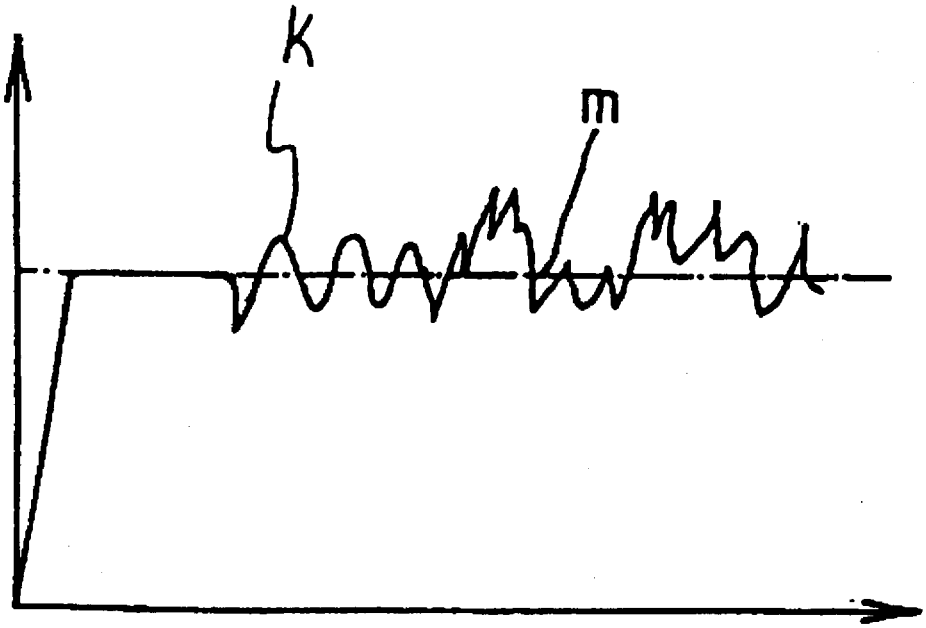
FIG. 6 is a diagram of the signal produced by the slub catcher.

Yarn 1, which is guided through the measuring slit 2' of a measuring head 2 of an electronic slub catcher, is monitored in the measuring slit 2' preferably optically or electronically without contact of the yarn with the walls of the measuring head 2. In the course of this, the yarn diameter, which is changing continually because of the yarn movement, or the yarn mass is detected, depending on the selected measuring system. With reference to FIG. 6, the slub catcher produces a signal that may be characterized as an alternating voltage k superimposed on a DC voltage level m. The alternating voltage generated by the electronic slub catcher is divided into three signals by a processing unit 3 and the resulting signals are fed into three evaluation channels 4',4",4'".

A catcher cutting signal for determining whether a yarn dimension is within a predetermined tolerance range is formed in the first evaluation channel 4'. This is performed using a low bandpass filter (not shown) by demodulation, i.e., by filtering out the amplitude fluctuations of the alternating voltage signal being generated in the measuring head 2. If an upper tolerance limit is exceeded, indicative of a yarn slub, or the signal falls below a lower tolerance limit indicative of yarn which is too thin, a cutting pulse is produced, which in this case is called a "catcher step". It is amplified and transmitted by a control unit 5 and a control line 6' to a separating device 6. After a predetermined time delay, the drive mechanism 7 of a yarn connecting device (not shown) is started using a control line 7'. In addition, a valve 8 is triggered using another control line 8', which, for a predetermined time period, connects a suction air line 10' projecting from a suction air source 10 with a suction air line 9' leading to a suction nozzle 9. This time period, designated as the yarn search time, can also be varied by making the drive mechanism 7 pause, which generally triggers the valve 8. If the valve 8 is to be controlled exclusively by the drive mechanism 7, the control line 8' would have to be disposed between the drive mechanism 7 and the valve 8. However, as shown in FIG. 1 and explained above, it is possible to trigger the valve 8 directly using the control unit 5.

Although the separating device 6 is indicated here only as a cutting device, it usually consists of a cutting device in the form of a separating blade and a clamping device, which together act as a separating device. The various separating steps will be explained in greater detail hereinafter.

A digitized static yarn signal produced from the alternating voltage signal is fed by the processing unit 3 to the second evaluation channel 4". It should be understood that the static yarn signal according to the present invention is not a signal received from the yarn at rest, but rather a signal indicative of the presence of the yarn independent of the movement of the yarn in the measuring slit of the slub catcher. The static yarn signal is generated by digitizing the alternating voltage signal being generated in the measuring head 2. In that regard, the switching threshold may be set to a lesser value, e.g., 25 percent of the normal yarn thickness, in order not to pick up thin portions of the yarn by the static yarn signal. With the static yarn signal, the absence of yarn is detected within milliseconds. Therefore, it is possible to detect the yarn for evaluation when it is leaving the measuring slit 2' because of "jumping".

While yarn movement cannot be detected based on the static yarn signal, it is possible to detect yarn movement using a dynamic yarn signal, appearing as "noise" in the third evaluation channel 4'". However, because the "noise" generated by the movement of the yarn can be almost completely missing, for example, in case of a relatively smooth yarn section, the evaluation channel 4'" is provided with a time delay allowing the dynamic yarn signal to drop a predetermined time period, e.g., 50 milliseconds, after the loss of the noise, which thereby causes the winding station to be stopped.

A control line 11' leading to the drive drum 11 is intended to indicate that the drum return can be set to equal the yarn search time. Further details in connection with this are described in greater detail hereinafter.

Figure 2:
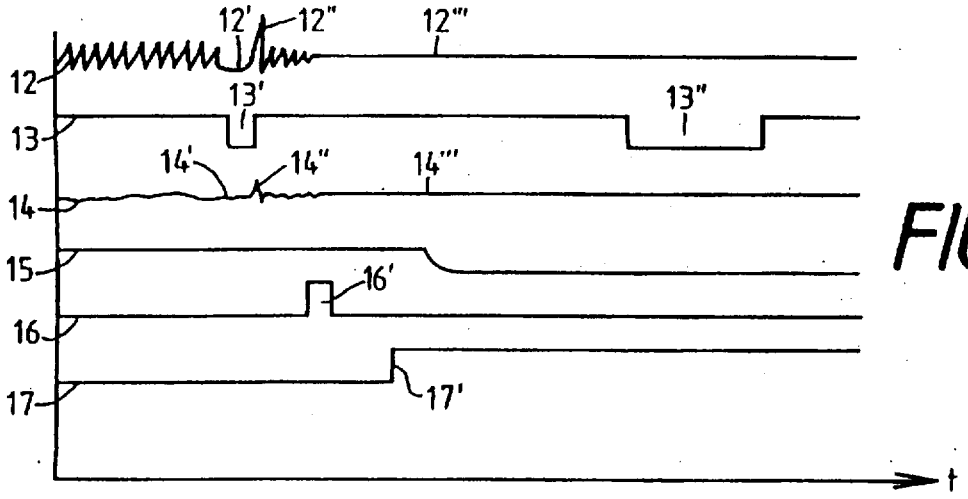
FIG. 2 is a timing diagram depicting signal progressions representative of a slub being detected coming up after the return of the yarn to the measuring slit of the electronic slub catcher.
Figure 3:
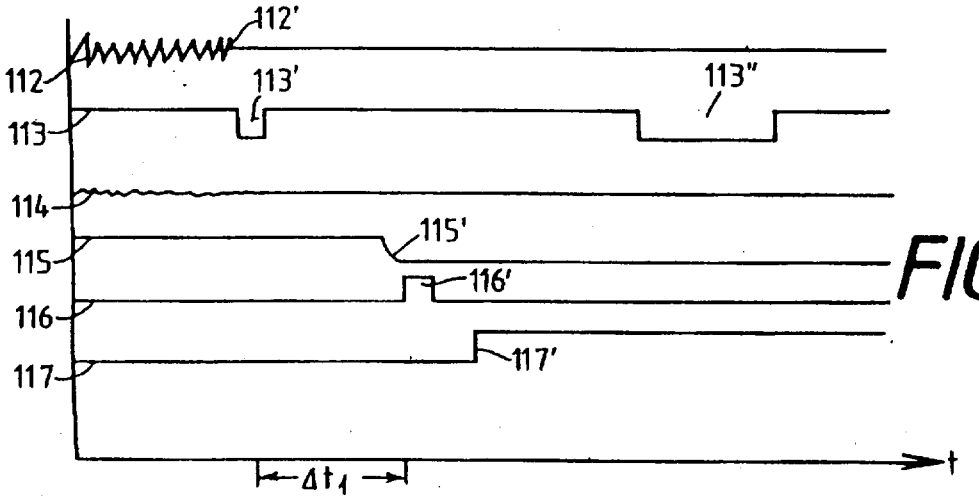
FIG. 3 is a timing diagram depicting signals representative of a yarn break between the slub catcher and the take-up bobbin.
Figure 4:
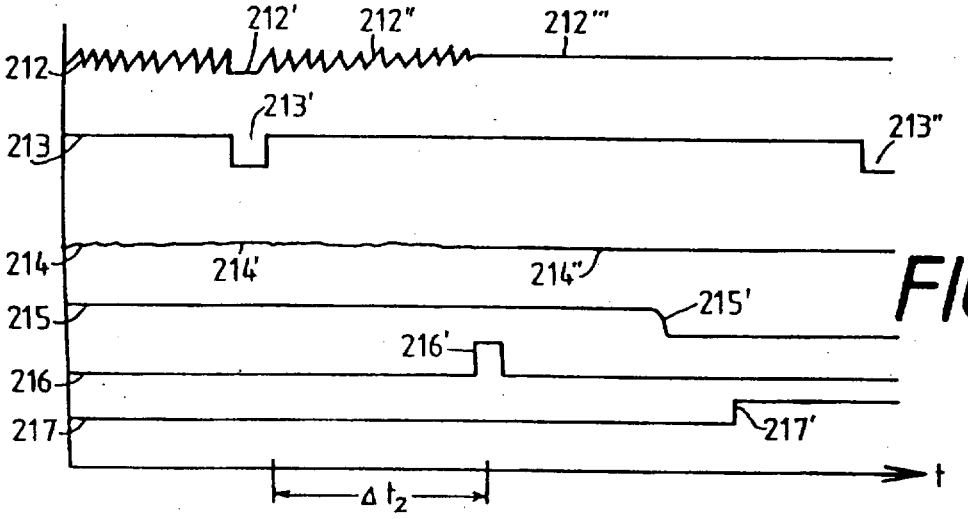
FIG. 4 is a timing diagram depicting signals representative of a situation wherein the separating signal based on a brief loss of the static yarn signal is forwarded after a predetermined time delay.

Timing diagrams are shown in FIGS. 2 through 4, which depict the progress over time of the signals for three different cases of winding interruption.

Looking first at FIG. 2, the alternating voltage signal generated by the movement of the yarn is identified by 12 in FIG. 2. A short, smooth segment identified at 12' indicates signal interruption because the yarn 1 has come out of the measuring slit 2'. A positive voltage peak 12" immediately follows this, which signals a slub in the yarn. Following this is a segment corresponding to normal yarn movement. The following segment 12'" indicates that yarn movement has halted caused by a separating pulse 16' within a signal 16 for the separating device 6 (see FIG. 1).

The static yarn signal directed through the second evaluation channel 4" is illustrated generally at 13. A brief escape of the yarn 1 from the measuring slit 2' (as illustrated in FIG. 1) is indicated by 13'. The signal collapse 13" is later during the yarn connecting cycle, when the yarn at the take-off bobbin has been acquired by a feeder and in the course of this, the yarn section located in the measuring slit 2' is also acquired.

A catcher cutting signal directed through the first evaluation channel 4' is illustrated generally at 14. There, the segment in which the yarn has left the measuring slit 2' is indicated at 14', and the amplitude deflection because of the slub is indicated at 14". The signal illustrated at 14'" also indicates that no amplitude fluctuations can be detected because of the absence of the alternating voltage signal when the yarn has been stopped because of the separating signal 16'. The signal 15 directed through the thread evaluation channel 4'" shows the dynamic yarn signal, which drops with a time delay in relation to the separating signal 16'. The signal 17 which identifies the start-up of the yarn connecting device indicates the start of the yarn connecting cycle at 17'.

It can be seen in the representation of FIG. 2 that a separating signal has been generated because a slub has been detected following the return of the yarn into the measuring slit 2', causing cancellation of the separating pulse generated due to the loss of the static yarn signal. Here, separation is performed in a manner wherein first a yarn cut is made and immediately thereafter upstream clamping of the yarn occurs.

Turning now to FIG. 3, a yarn break has occurred between the slub catcher and the take-up bobbin. In the process, and with reference to FIGS. 1 and 2, the yarn 1 first briefly left the measuring slit 2', as indicated by the static signal 113 at 113'. The segment at 112' in the voltage curve 112 indicates that the alternating voltage signal is no longer present and does not return, indicating that the yarn 1 no longer moves after returning into the measuring slit 2'. A corresponding signal results for the catcher cutting signal 114. The dynamic yarn signal 115 shows the drop of this signal at 115' with the result being the commencement of the yarn connecting cycle depicted at 117' within the start up signal 117 for the yarn connecting device. The separating signal 116 indicates that a separating pulse 116' is issued immediately following the drop 115' of the dynamic yarn signal 115. However, in contrast to the first example, this separating pulse 116' triggers the reverse separating sequence, wherein clamping is performed first and then the yarn end, which normally is aspirated by a yarn capture nozzle, is cut, after which it is completely aspirated.

The predetermined length of time $t_1$, indicated in FIG. 2, represents the aforementioned delay between the time of the noise signal and the drop of the dynamic yarn signal 115.

The most important situation with respect to the present invention is illustrated in FIG. 4, wherein the winding of an as-yet undetected yarn defect is prevented. It can be seen at segments 212', 213', and 214' that a brief escape of the yarn 1 from the measuring slit 2' has occurred. In this case, only the respective static yarn signal 213' is usable for evaluation. The AC voltage signal segment 212" results in neither a catcher cutting signal within the signal 214 which can be evaluated, nor is there a loss of the static yarn signal in this area, due to the brief time in which the yarn was out of the measuring slit. After a predetermined length of time $t_2$, which is longer than $t_1$, the stored separating signal 216' within the signal 216 is then triggered as a result of the static yarn signal 213'. The smooth segment 212'" in the AC voltage signal 212 and the segment 214" in the catcher cutting signal 214 are the result of this. Following yarn separation and after a further predetermined time period corresponding to the first predetermined time period $t_1$, the dynamic yarn signal 215 also drops, at a position indicated at 215' which has no effect because of the prior separation of the yarn. As shown by the signal 217, the yarn connecting cycle is started at 217'.

Figure 5:
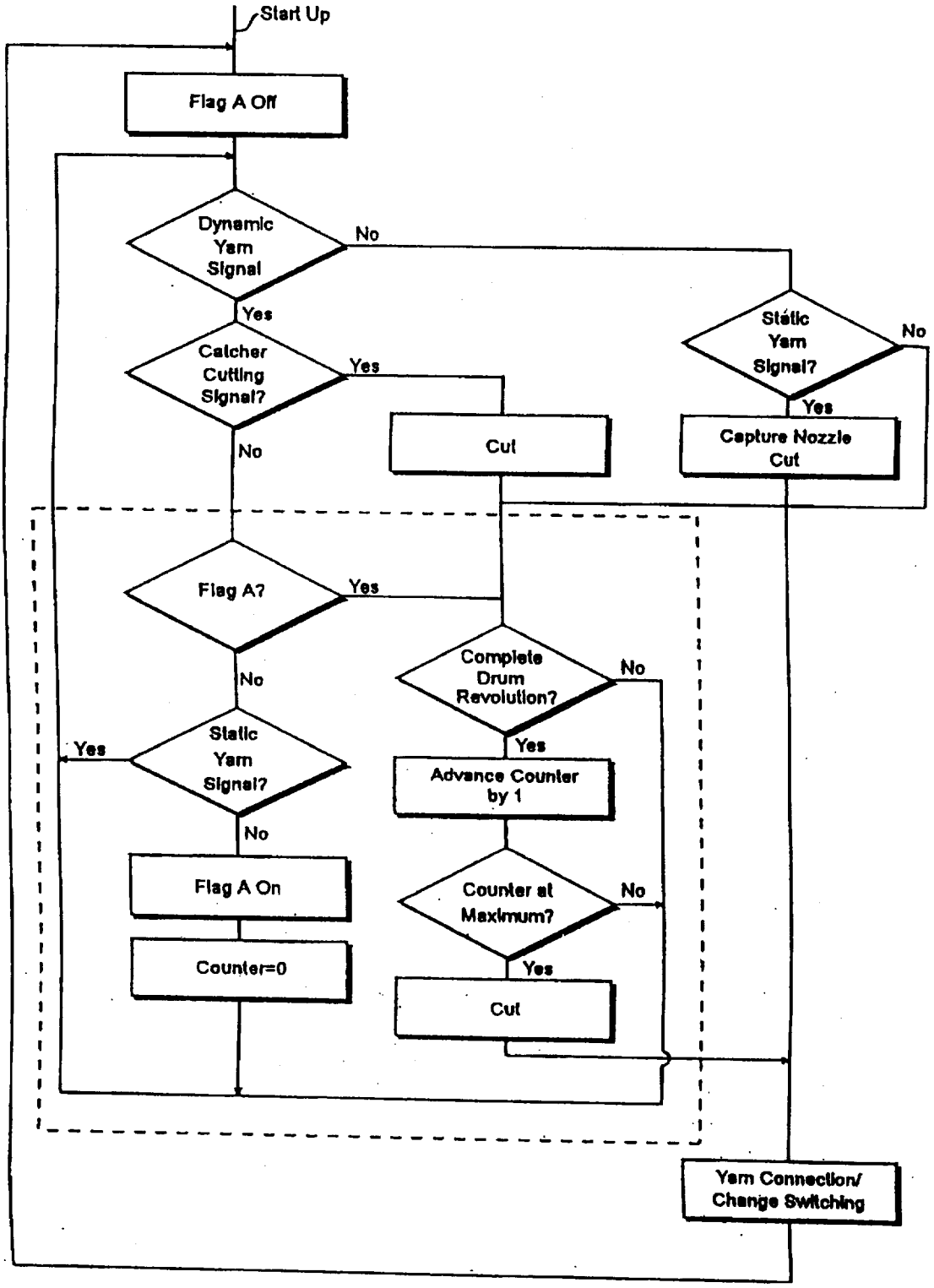
FIG. 5 is a flow chart which depicts the method steps in accordance with the preferred embodiment of the present invention.

The flow diagram of FIG. 5 is intended to depict the essential steps which have to be performed according to the method of the present invention. After start-up of the winding station, following the yarn connection or a bobbin change, by way of example, first a flag A is switched off, provided it had been previously set because of the loss of the static yarn signal of the moving yarn. If the result of the subsequent interrogation of the dynamic yarn signal is negative, the presence of the static yarn signal of the stopped yarn is sought. If this signal is present, it indicates a yarn break between the catcher and the take-up bobbin. Then, a so-called "capture nozzle cut" is performed, wherein after clamping, the yarn end aspirated by the capture nozzle is separated from the clamped yarn end and can be aspirated by the capture nozzle. A yarn connecting circuit is started thereafter. If the yarn on the take-off side cannot be fed by the yarn connecting circuit, a bobbin change is performed by means of this circuit (change switching). If there is no static yarn signal resulting from the stopped yarn, it is assumed that the yarn has broken between the take-off bobbin and the catcher and that therefore a capture nozzle cut could be required. Therefore, the yarn connecting circuit is immediately triggered.

If there was a dynamic yarn signal, an interrogation is performed to determine whether a catcher cutting signal must be emitted because of a yarn irregularity. If so, a cut with subsequent clamping is performed. After this, the yarn connecting circuit is started.

If there is no catcher cutting signal, the flag A is interrogated. If it is canceled or not switched on, the static yarn signal is interrogated independently of the lack of the dynamic yarn signal. If the static yarn signal is present, the interrogation cycle again starts with the interrogation of the dynamic yarn signal. If, momentarily, there is no static yarn signal, the flag A is switched on. A counter is set to zero or to some other predetermined starting value. After this, the dynamic yarn signal is again interrupted which has not yet dropped immediately following the loss of noise. If there is no catcher cutting signal, the flag A, which is now set, is interrogated. After this, an inquiry is made regarding drum revolutions, for example, which are customarily monitored. As long as there has not been a complete revolution of the drum, the above described interrogation cycle is started again. After one drum revolution, the counter is advance by one. Subsequently, an inquiry is made whether a previously entered maximum or threshold value has been reached in the counter. If not, the interrogation cycle is again performed until the number of revolutions of the drum has reached the set maximum counter value. The cut is then performed which results in the start of the yarn connecting circuit.

The interrogation cycle always includes the interrogation of the dynamic yarn signal and the catcher cutting signal. Therefore, it is assured that any cut resulting from the lack of the static yarn signal occurs only if the dynamic yarn signal and the catcher cutting signal have not previously triggered a separating signal pulse.

As can be further seen from FIG. 5, the separating pulse which can be generated based on the absence of the static yarn signal is triggered entirely independently of the time period of the absence of the static yarn signal in that the flag A is set immediately. Therefore, it is possible to detect a brief escape of the yarn from the measuring slit as well as a permanent escape. In this manner, it is also possible to detect a yarn break or an escape of the yarn from the measuring slit in case the dynamic yarn signals were an anomaly resulting from electromagnetic interference from an electrical device associated with the winding station.

Since the length of time indicated by $t_2$ in FIG. 4 is greater than the length of time which usually occurs between a yarn defect and the separation of the yarn, an increased yarn length is wound on the take-up bobbin following the defective yarn segment. It is therefore necessary to increase the yarn capturing time of the yarn on the side of the take-up bobbin in a case where the separating process had been performed exclusively on the basis of the absence of the static yarn signal. Then, the suction time at the suction nozzle 9 as well as the reverse turning time of the drive drum 11 are increased. With reference to FIG. 1, this control takes place using the control lines 8' and 11'.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for monitoring a traveling yarn at a winding station of an automatic winding machine having an electronic slub catcher which produces a first electric signal responsive to yarn movement and a second electric signal responsive to yarn diameter being outside a predetermined tolerance range as the yarn passes through the slub catcher, the first signal being identified as a dynamic yarn signal and the second signal being identified as a yarn cutting signal, the method comprising the steps of:

providing means associated with the electronic slub catcher for producing a third electric signal responsive to the presence of yarn in the electronic slub catcher, said third signal being identified as a static yarn signal;

producing said static yarn signal using said third electric signal producing means; and monitoring and evaluating said static yarn signal.

2. A method for monitoring a traveling yarn according to claim 1 and further comprising the steps of providing means associated with the electronic slub catcher for producing a fourth electric signal responsive to the absence of said static yarn signal due to the absence of yarn from the electronic slub catcher, said fourth signal being identified as a separating signal and monitoring and evaluating said separating signal.

3. A method for monitoring a traveling yarn according to claim 1 and further comprising the steps of:

deriving said static yarn signal from the alternating voltage produced by the electronic slub catcher; and digitizing said static yarn signal for enhanced monitoring and evaluation.

4. A method for monitoring a traveling yarn according to claim 1 and further comprising the steps of retaining in a memory location a separating signal generated prior to the expiration of a predetermined time period following the absence of said static yarn signal; determining whether a separating signal is emitted from the slub catcher resulting from a signal generated when the yarn reenters a measuring slit of the slub catcher and when the yarn dimension is outside the predetermined tolerance range; and transmitting said stored separating signal to a yarn manipulating device as a result of a positive determination that a separating signal has been emitted from the slub catcher resulting from a signal generated when the yarn reenters the measuring slit of the slub catcher and when the yarn dimension is outside the predetermined tolerance range.

5. A method for monitoring a traveling yarn according to claim 1 and further comprising the steps of retaining in a memory location a separating signal generated as a result of the absence of said static yarn signal; determining whether the dynamic yarn signal is absent during a predetermined time period; and transmitting said separating signal to a yarn manipulating device responsive to a determination that the dynamic yarn signal has been absent for said predetermined time period.

6. A method for monitoring a traveling yarn according to claim 1 and further comprising the steps of determining whether a generated separation signal results from a loss of the static yarn signal; increasing the length of a yarn portion unwound during unwinding of detected yarn on an output side of the slub catcher responsive to a positive determination that said generated separation signal has resulted from the loss of the static yarn signal, the amount of increased length being sufficient to cause a yarn portion causing the absence of the static yarn signal to be aspirated by a suction nozzle during a yarn connecting operation.

* * * * *